United States Patent [19]

Abbott et al.

[11] Patent Number: 4,950,098

[45] Date of Patent: Aug. 21, 1990

[54] SLAT FENCE RETAINER

[75] Inventors: Joshua B. Abbott; Patrick E. Kohls, both of Salem; Joseph W. Schoenheit, Portland, all of Oreg.; Fred O. Walden, Tacoma, Wash.

[73] Assignee: VIP Company, Clackamas, Oreg.

[21] Appl. No.: 367,004

[22] Filed: Jun. 16, 1989

[51] Int. Cl.[5] ..... B21F 27/00

[52] U.S. Cl. ..... 403/34; 403/35; 245/11

[58] Field of Search ..... 256/34, 35; 245/11; 5/93 R; 52/823

[56] References Cited

U.S. PATENT DOCUMENTS

| | | | |
|---|---|---|---|
| 2,636,189 | 4/1953 | Feldman | 5/93 R |
| 2,760,759 | 8/1956 | Rice . | |
| 3,356,343 | 12/1967 | Taylor . | |
| 3,452,501 | 7/1969 | Zimmer et al. | 52/823 X |
| 3,485,006 | 12/1969 | De Rozario | 52/731 |
| 3,572,640 | 3/1971 | Vecchiarelli . | |
| 3,712,590 | 1/1973 | Tochner et al. . | |
| 3,822,053 | 7/1974 | Daily . | |
| 4,085,954 | 4/1978 | Thompson . | |
| 4,570,906 | 2/1986 | Walden . | |
| 4,723,761 | 2/1988 | Cluff | 256/34 |
| 4,725,044 | 2/1988 | Cluff . | |

*Primary Examiner*—Andrew V. Kundrat

*Attorney, Agent, or Firm*—Kolisch, Hartwell & Dickinson

[57] ABSTRACT

A slat fence retainer for retaining slats in a chain-link fence includes a horizontally disposed slat-retaining element having a pair of spaced apart side walls, a base joining the bottom margin of the side walls and an open top. The element includes a vertical-slat retention means thereon. Plural, vertical slat elements are predimensioned to be received in the links in the fence. Each vertical slat element has at least one substantially planar and resilient flange at an end thereof and slots formed adjacent the end for engagement with the slat retention means to hold the vertical slat element in the fence.

20 Claims, 2 Drawing Sheets

SLAT FENCE RETAINER

BACKGROUND AND SUMMARY OF THE INVENTION

The instant invention relates to vision-obstructing slats which are used in chain-link fences, and specifically to vision-obstructing elements which lock together to retain the elements in the fence web.

The chain-link fence is a popular form of area enclosure because of its relatively inexpensive cost and the speed with which it may be erected. However, the chain-link fence does very little to afford privacy to the enclosed area because of the open mesh construction of the fence web. One means of providing privacy is to install slats into the links of the fence to obstruct vision through the fence. Various forms of slats are known, the oldest form being of wooden construction and, in recent years, slats made out of plastomer materials have been used. Plastomer slats are disclosed in U.S. Pat. Nos. 4,085,954; 4,512,556 and 4,570,906.

The slats, however, are subject to deterioration, in the case of wooden slats, may become damaged and work their way out of position or, may be removed by vandals, thereby leaving a gap in the fence.

A number of forms of retaining mechanisms have been proposed to prevent removal of slats and such mechanisms are described in the first two-mentioned patents above, as well as in pending application No. 07/170,406. The known retaining mechanisms involve multiple piece installation and, while adequate to retain slats in the fence, are somewhat more complicated than the retainer described in the instant disclosure.

An object of the instant invention is to provide a one-piece slat-retaining element.

Another object of the instant invention is to provide a vision obscuring slat which will lock into the slat retaining element of the invention.

A further object of the instant invention is to provide slat elements which will retain vertically disposed privacy slats in place in a chain-link fence.

Still another object of the instant invention is to provide a slat retaining element which is easily installed in the fence, inexpensive to manufacture, and which does not distract from the aesthetic appearance of the fence.

The slat fence retainer of the invention is intended for use with a chain-link fence and includes an elongate, horizontal slat element which is predimensioned to be interwoven between horizontally consecutive links in the fence and which has a pair of spaced apart side walls, a base joining the bottom margins of the side walls and an open top. The horizontal slat element further includes vertical-slat retention means thereon. Plural vertical slat elements are provided which are predimensioned to be interwoven between vertically consecutive links in the fence. In one form of the invention, each vertical slat element has opposed, spaced apart, substantially planar faces integrally formed with opposed, spaced apart curved edges which extend between the faces. An end of each vertical slat element includes a pair of substantially planar and resilient spaced apart flanges which have slots formed therein adjacent the end of the elements which engage the slat retention means of the horizontal slat elements, thereby holding the vertical slat elements in the fence. In another form of the invention, vertical slats are formed of a single thickness of polymeric material.

These and other objects and advantages of the invention will become more fully apparent as the description which follows is read in conjunction with the drawings.

DETAILED DESCRIPTION OF THE PREFERRED EMBODIMENTS

Figure 1:
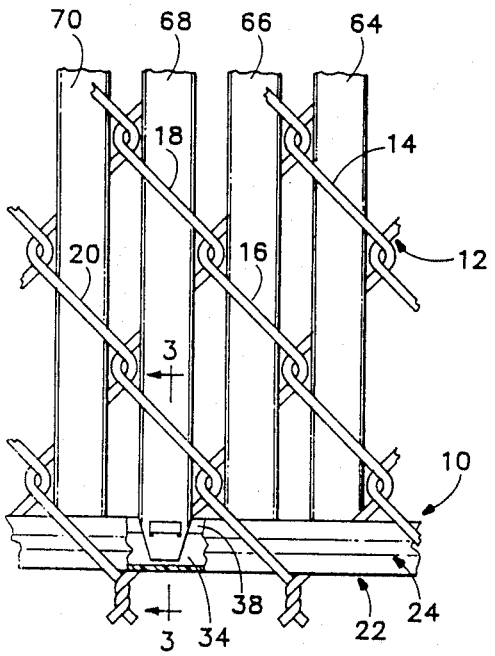
FIG. 1 is a front elevational view of a portion of a chain-link fence, having one form of the retainer of the invention installed therein.

Referring now to the drawings, and initially to FIG. 1, one form of the slat fence retainer of the invention is shown generally at 10 installed in a chain-link fence 12. Fence 12 includes links, such as links 14, 16, 18 and 20 which are interwoven to form the web of the fence.

Figure 2:
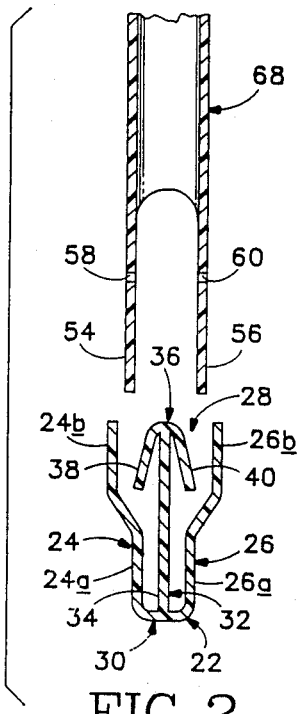
FIG. 2 is an exploded, cross section of the slat fence retainer and a vertical slat of FIG. 1.
Figure 3:
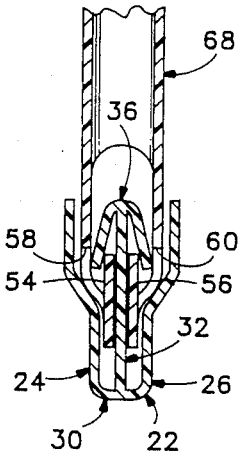
FIG. 3 is a cross section of the slat fence retainer of the invention, taken generally along the line 3—3 of FIG. 1.

Retainer 10 includes a slat retaining element 22 which is an elongate, horizontally extending element predimensioned to be interwoven between horizontally consecutive links in the fence. Although the retaining element is depicted installed in lower links in the fence, it should be understood that the retaining element may also be installed in the upper links. Referring now to FIGS. 2 and 3, slat retaining element 22 includes a pair of spaced apart side walls 24 and 26, each of which, in this embodiment, has a lower portion *24a*, *26a* and an upper, outwardly flared portion *24b*, *26b*, respectively, adjacent the upper margin thereof. The flared, upper portion is provided to facilitate insertion of vertically disposed slats into retainer elements 22. The vertical slats of the invention will be described later herein. An open top 28 is present and extends between the upper margins of the side walls.

A base 30 extends between the lower margins of side walls 24 and 26 and is joined thereto.

Slat retention, or retaining, means 32 is, in this embodiment, secured to base 30 between side walls 24 and 26. In this embodiment, retention means 32 includes a projection extending upwards from base 30 which includes a vertically extending stalk 34 which is connected at the lower side thereof to base 30 and a slot-means engaging head 36 which is located at the other end of the stalk. In this embodiment, head 36 has an arrow-head like form which points in an upward direction. A pair of flanges 38, 40 extend to either side of stalk 34, with the free edges thereof extending downward from the tip of head 36 to either side of stalk 34 and aligning in an overlapped condition with the lower portions 24a, 26a of side walls 24, 26, respectively.

Element 22 may be formed by an extrusion process such that the sides, base, stalk and head are all integrally formed with one another.

Figure 4:
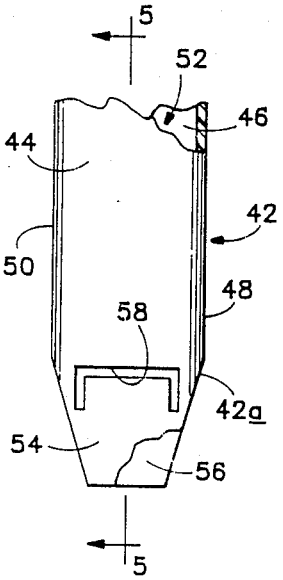
FIG. 4 is a front elevation view of a vertical slat element of the invention.
Figure 5:
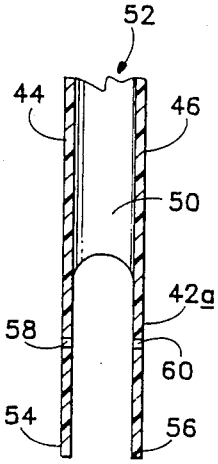
FIG. 5 is a side sectional view of the vertical slat element, taken generally along the line 5—5 of FIG. 4.

Referring now to FIGS. 4 and 5, one form of vertical slat element constructed according to the invention is shown generally at 42. Element 42 tubular in nature and is predimensioned to be interwoven between vertically consecutive links in the fence. In this embodiment, element 42 includes a pair of opposed, spaced apart, substantially planar faces 44, 46 which are integrally formed with opposed, spaced apart curved edges 48, 50, which extend between the faces. An open space 52 extends through the length of element 42.

The lower end 42a of element 42 includes a pair of substantially planar and resilient, spaced apart flanges 54, 56 which are formed by cutting away edges 50, 52, leaving faces 44, 46 in an unjoined condition. In this embodiment, the cut is made to provide an inward taper from the edges of the element toward the bottom of the flanges.

Slots 58, 60 are formed in flanges 54, 56, respectively. Together, slots 58 and 60 comprise what is referred to herein as slot means which are located adjacent the lower end of element 42 for engaging with slot retention means 32. The slots formed in element 42 have a substantially rectangular form, as depicted in FIG. 4.

Figure 6:
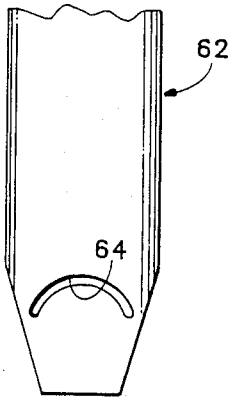
FIG. 6 is a front elevation of one alternate form of the vertical slat element of the invention.

Referring now to FIG. 6, a second form of vertical slat element is depicted generally at 62. Element 62 is constructed similarly to element 42 except that slot 64 has a substantially curvilinear form. A suitable material for forming the retaining elements and vertical slats thus far described as high density polyethylene.

Referring now to FIGS. 1–3, one way to install the slat fence retainer of the invention in a chain-link fence will be described. Slat retaining elements, such as element 22 are initially inserted in the fence web along the bottom margin of the web between horizontally consecutive lower links. Vertical slat elements, such as 64, 66, 68 and 70, which may be constructed like element 42 or element 62, are then inserted through vertically consecutive links in the fence and inserted into slat retaining element 22 with flanges 54, 56 of the vertical slat elements extending inwards of flared side wall portion 24a, 26a and outward of flanges 38, 40 of engaging head 36. Once the vertical slats are inserted deep enough into retaining element 22, flanges 38, 40 of head 36 will extend partially through the slots in the lower portions of the vertical slats while vertical element flanges 54, 56 bend around head 36 into the regions between sides 24, 26 and stalk 34, thereby locking the slats in place in the fence. The lower side walls 24a, 26a will press flanges 54, 56 together to insure grasping by head 36. Once installed, the vertical slats may not be easily removed and will remain in place.

Figure 7:
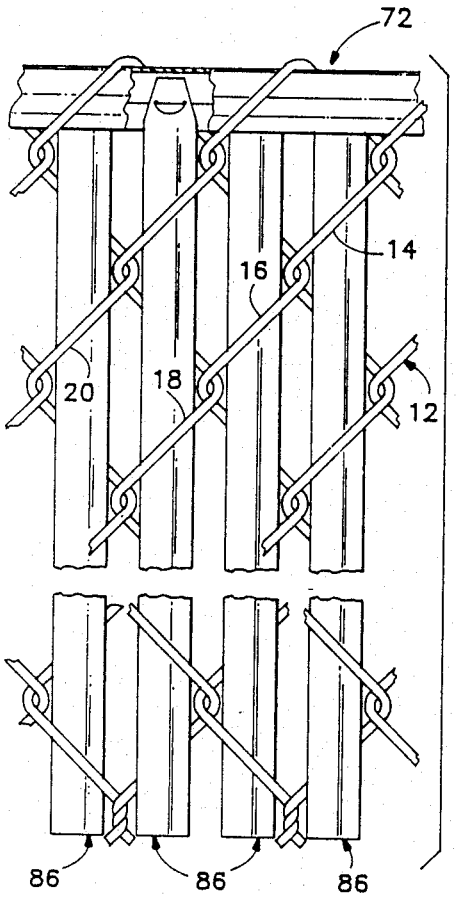
FIG. 7 is an alternate embodiment of the invention installed in a portion of a chain-link fence.

Another way to install the slat fence retainer is depicted in FIG. 7, in connection with an embodiment of the invention which will be described later herein. This installation method includes initially inserting the vertical slat elements through vertically consecutive links in the fence, with the flange-bearing end of the slats adjacent the upper edge of the fence web. The flanged ends of the slats may be disposed slightly below the upper margin of the web and allowed to rest on the ground surface. Once the vertical slats are inserted, slat retaining elements may be installed between horizontally consecutive upper links in the fence, thereby forming a top cap for the retainer. Once the retaining elements are in place, the vertical slat elements may be drawn upward into the interior of the retaining elements such that the slots engage the flanges of the slat retention means. Thus, the vertical slats in effect hang from the retaining elements.

In the event that it is necessary to remove one or more vertical slat elements, flanges 38, 40 may be pressed inward of the slots in the vertical slat elements, thereby freeing the vertical slats for removal from the fence web, or, retaining element 22 may be withdrawn horizontally to free the vertical slats.

Figure 8:
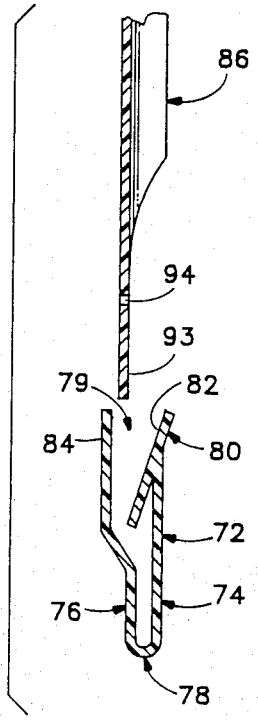
FIG. 8 is an exploded, cross section of the slat fence retainer and a vertical slat of FIG. 7.
Figure 9:
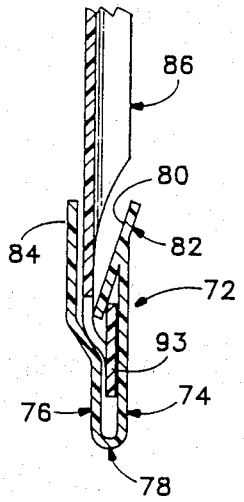
FIG. 9 is a cross section of the slat fence retainer of FIG. 7, taken generally along the line 9—9 of FIG. 7, shown in an inverted position.
Figure 12:
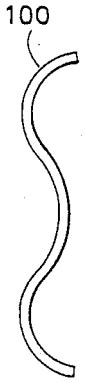
FIGS. 11–14 are end views of vertical slat elements having various configurations.
Figure 13:
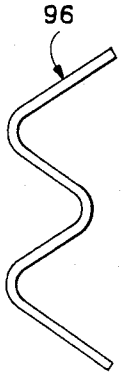
Figure 14:
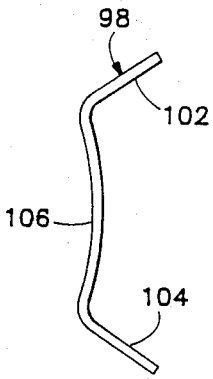
Figure 11:
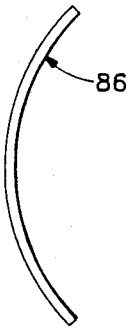
Figure 10:
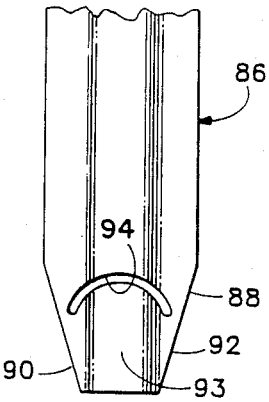
FIG. 10 is a front elevation view of the vertical slat element of FIG. 7.

Another form of the invention is depicted in FIGS. 7–14. Referring initially to FIGS. 7–9, a slat retaining element 72 includes a pair of spaced apart side walls 74, 76 which are joined at the lower margins thereof by a base 78. One side wall, 74 has an integrally formed vertical-slat retention means 80 formed thereon. In this embodiment, retention means 80 includes a diagonally extending slot-means engaging head 82 formed on the top margin thereof. The top margin of side wall 74 is fixed to engaging head 82, also referred to herein as retaining structure, intermediate the ends of the head. Head 82 projects into the region between side wall 74 and 76.

The other side wall 76 has an outwardly flared portion 84 adjacent the upper margin thereof. An open top 79 allows insertion of a vertical slat element. Retaining element 72 may be formed from a variety of thermal plastic resins, such as high density polyethylene or polyvinyl chloride (PVC), or the retaining element may be formed from an appropriate metal, such as aluminum.

Referring now to FIGS. 7–10, another form of a vertical slat element is depicted at 86. Vertical slat element 86 is formed of a single thickness of thermal plastic resin material, such as PVC. One end 88 of vertical slat element 86 is formed with tapered sides 90, 92 and has a slot, or slot means 94 formed therein. Tapered sides 90, 92 form a flange 93 which is received in the interior region of retaining element 72. The tapered sides facilitate insertion of the vertical slat element into the retaining element.

Referring now to FIGS. 11–14, slat elements 86, 96, 98 and 100 are depicted in end views, respectively, showing a variety of forms which vertical slat elements may take when constructed according to this embodiment of the invention. Much greater variety of vertical slat configuration is possible when a single thickness of thermal plastic resin material is used to form the vertical slats. Slat 86 is depicted as having a simple curved profile. Slat 96 has a zig-zag configuration while slat 98 has a pair of opposed side walls 102, 104 with a dished intermediate section 106. Slat 100 has what may be thought of as a sinusoidal profile. The slat may be formed with other configurations to meet special needs or esthetic requirements.

Although the tubular vertical slat element has been described in connection with the first embodiment of a slat retaining element shown in FIGS. 1–3, and the single layer vertical slat element has been shown in connection with slat retaining element 72 shown in FIGS. 7 and 8, it should be appreciated that the retaining elements and vertical slat elements are interchangeable in that the single layer vertical slat element may be used with slat retaining element 22 while the tubular vertical slat elements may be used with retaining element 22, so long as the flanges on the tubular elements are of sufficient length to allow insertion of one of the flanges into the interior region of the retaining element, thereby providing engagement between slat means engaging head 82 and the slot in the vertical slat. Either embodiment may be installed with the vertical slat retaining means at the top or bottom of the fence web.

The single thickness vertical slat has much smaller shipping dimension as the slats can be stack nested on one another, thereby eliminating a great deal of air space which is present in the interior of the tubular vertical slat.

Thus, a slat fence retainer has been disclosed with is easily installed in the web of a chain-link fence and will prevent the removal by natural or intentional forces of the vertically extending, vision obscuring slats from the fence.

Although a preferred embodiment of the invention and a variation thereto have been disclosed herein, it should be appreciated that further variations and modifications may be made thereto without departing from the scope of the invention as described in the appended claims.

It is claimed and desired to secure as Letters Patent:

1. A slat fence retainer for retaining slats in a chain-link fence comprising:

an elongate, horizontal slat retaining element predimensioned to be interwoven between horizontally consecutive links in the fence, having a pair of spaced apart side walls, a base joining the bottom margins of said side walls, and an open top, said element further including integrally formed vertical-slat retention means having a projection extending upwardly from said base, said projection having a substantially vertically extending stalk connected at one end thereof to said base and a slot-means engaging head at the other end thereof; and plural vertical slat elements predimensioned to be interwoven between vertically consecutive links in the fence and to have an end of each slat received between said side walls of said horizontal slat retaining element, said vertical slat element further including slot means located adjacent an end thereof for engagement with said retention means to hold said vertical slat element in the fence.

2. The retainer of claim 1 wherein said slot-means engaging head has an upwardly pointing arrow-head like form including a flange projecting to either side of said stalk.

3. The retainer of claim 1 wherein each of said side walls has an outwardly flared portion adjacent the upper margin thereof.

4. The retainer of claim 1 wherein said vertical-slat slot means has a substantially rectangular form.

5. The retainer of claim 1 wherein said vertical-slat slot means has a substantially curvilinear form.

6. The retainer of claim 1 wherein said vertical slat element has opposed, spaced apart, substantially planar faces integrally formed with opposed, spaced apart curved edges which extend between said faces, each vertical slat element having an end including a pair of substantially planar and resilient, spaced apart flanges.

7. The retainer of claim 1 wherein said vertical slat is constructed and arranged from a single thickness sheet of material.

8. A slat fence retainer for retaining slats in a chain-link fence comprising:

an elongate, horizontal slat retaining element predimensioned to be interwoven between horizontally consecutive links in the fence, having a pair of spaced apart side walls, a base joining the bottom margins of said side walls, and an open top extending between the free, upper margins of said side walls, said element further including a projection extending upwardly from said base along the length of said horizontal element and integrally formed with said horizontal element, said projection including a substantially vertically extending stalk connected along one edge thereof to said base and a slot-means engaging head extending along the free edge thereof; and plural, elongate vertical slat elements predimensioned to be interwoven between vertically consecutive links in the fence, each of said vertical slat elements having opposed, spaced apart, substantially planar faces integrally formed with opposed, spaced apart curved edges which extend between said faces, said faces and edges surrounding an open space extending the length of the vertical slat, each vertical slat element having an end including a pair of substantially planar and resilient, spaced apart flanges, which taper inwardly from said edges, said vertical slat element further including slot means located adjacent said end for engaging said slat retention means to hold said vertical slat element in the fence.

9. The retainer of claim 8 wherein said slot-means engaging head has an upwardly pointing arrow-head like form including a flange projecting to either side of said stalk.

10. The retainer of claim 8 wherein said slot means has a substantially rectangular form.

11. The retainer of claim 8 wherein said slot means has a substantially curvilinear form.

12. The retainer of claim 8 wherein said side wall has an outwardly flared portion adjacent the upper margin thereof.

13. A slat fence retainer for retaining slats in a chain-link fence comprising:

an elongate, horizontal slat retaining element predimensioned to be interwoven between the horizontally consecutive links in the fence, having a pair of spaced apart side walls, a base joining the bottom margins of said side walls, said element further including a diagonally extending vertical-slat retaining structure integrally formed on one of said side walls and fixed to the top margin thereof, said vertical slat retaining structure projecting into the region between said side walls at one end thereof and projecting above said one side wall at the other end thereof; and plural elongate vertical slat element predimensioned to be interwoven between vertically consecutive links in the fence, said vertical slat element further including slot means located adjacent an end thereof for engaging said vertical slat retaining structure to hold said vertical slat element in the fence.

14. The retainer of claim 13 wherein the other side wall has an outwardly flared portion adjacent the upper margin thereof.

15. The retainer of claim 13 wherein said vertical slat is constructed and arranged from a single thickness of material.

16. The retainer of claim 13 wherein said vertical slat is constructed and arranged from tubular material, each vertical slat element having opposed, spaced apart, substantially planar faces integrally formed with opposed, spaced apart curved edges which extend between said faces, said faces and edges surrounding an open space extending the length of the vertical slat, each vertical slat element having an end including a pair of substantially planar and resilient, spaced apart flanges, which taper inwardly from said edges.

17. The retainer of claim 13 wherein said vertical-slat slot means has a substantially rectangular form.

18. The retainer of claim 13 wherein said vertical-slat slot means has a substantially curvilinear form.

19. A slat fence retainer for retaining slats in a chain-link fence comprising:

an elongate, horizontal slat retaining element predimensioned to be interwoven between horizontally consecutive links in the fence, having a pair of spaced apart side walls, a base joining the bottom margin of said side walls, and an open top, said element further including integrally formed vertical-slat retention means including a diagonally extending slot-means engaging head, said slot-means engaging head being formed on one of said side walls and fixed to the top margin thereof, the other of said side walls having an outwardly flared portion adjacent the upper margin thereof; and plural vertical slat element predimensioned to be interwoven between vertically consecutive links in the fence, said vertical slat element further including slot means located adjacent an end thereof for engagement with said slat retention means to hold said vertical slat element in the fence.

20. A slat fence retainer for retaining slats in a chain-link fence comprising:

an elongate, horizontal slat retaining element predimensioned to be interwoven between horizontally consecutive links in the fence, having a pair of spaced apart side walls, a base joining the bottom margins of said side walls, and an open top, said element further including integrally formed vertical-slat retention means including a diagonally extending slot-means engaging head, said slot-means engaging head being formed on one of said side walls and fixed to the top margin thereof and wherein the other of said side walls has an outwardly flared portion adjacent the upper margin thereof; and plural vertical slat elements predimensioned to be interwoven between vertically consecutive links in the fence and to have an end of each slat received between said side walls of said horizontal slat retaining element, said vertical slat element further including slot means located adjacent an end thereof for engagement with said slat retention means to hold said vertical slat element in the fence.

* * * * *